United States Patent [19]

Edelson

[11] Patent Number: 5,029,350

[45] Date of Patent: Jul. 9, 1991

[54] CROSS-LEGGED SEATING APPARATUS

[76] Inventor: Nathan Edelson, 526 Hickory St., Missoula, Mont. 59801

[21] Appl. No.: 636,690

[22] Filed: Dec. 31, 1990

[51] Int. Cl.[5] ..... A47C 16/00; A47C 27/14

[52] U.S. Cl. ..... 5/431; 5/465; 5/420; 297/183; 297/229

[58] Field of Search ..... 5/420, 431, 437, 465; 297/183, 219, 229, 382

[56] References Cited

U.S. PATENT DOCUMENTS

| | | | |
|---|---|---|---|
| 3,333,286 | 8/1967 | Biolik | 5/431 |
| 4,518,203 | 5/1985 | White | 297/456 |
| 4,635,306 | 1/1987 | Willey | 5/431 |
| 4,673,216 | 6/1987 | Alfer | 297/452 |
| 4,802,249 | 2/1989 | Bills | 5/431 X |
| 4,925,241 | 5/1990 | Geraci | 297/229 |
| 4,985,952 | 1/1991 | Edelson . | |
| 4,987,625 | 1/1991 | Edelson | 5/431 |

OTHER PUBLICATIONS

Advertisement for "Lotus Seat", P.O. Box 61, Cardiff by the Sea, CA 92007.

Page from "Small Wonders Futons" Catalog, Stevensville, MT 59870.

Page from "Yoga Props" Catalog from Harmony In Wood, Denver, CO 80231.

*Primary Examiner*—Michael F. Trettel

[57] ABSTRACT

Two cushions, one of trapezoidal and one of rectangular cross-section, are flexibly joined so as to provide optimum support for cross-legged sitting. The cushions may be folded one upon the other and carried via an integral handle which may be partially concealed in the flexible joint.

7 Claims, 2 Drawing Sheets

CROSS-LEGGED SEATING APPARATUS

FIELD OF THE INVENTION

This invention relates to seating devices, specifically to such devices intended for cross-legged sitting.

1. Background of the Invention

The use of the floor as a primary living surface offers a number of adavantages of a health, aesthetic and space-saving nature. However, in order to use the floor in this manner in a modern Western context requires new and novel furniture devices such as my recently patented Adjustable Personal Support Apparatus and Flexibly Hinged Convertible Mattress. An additional new and novel device is the subject of this patent, a cross-legged seating apparatus permitting comfortable and biomechanically correct cross-legged sitting regardless of floor type, and also allowing easy transport and compact storage of the appartus when not in use.

2. Discussion of Prior Art

The zafu, a fiber-filled, pumpkin-shaped cushion with truncated top and bottom, has been used for centuries for cross-legged meditative sitting by Japanese monks, and such zafus are available in this country. However, zafus compact readily and hence quickly lose their resiliency unless frequently restuffed, a nuisance and expense. Moreover, the zafu provides no support for feet, ankles and shins, and hence is painful to use on many floor surfaces. A complementary thinner and wider cushion to provide foot ankle and shin support, called a zabuton, is sometimes used in conjunction with the zafu, however such zabutons also suffer from rapid compaction and loss of resiliency, and because they are not connected to the zafu, they are awkward to carry and store.

U.S Pat. No. 4,673,216 to Afer recites a basic lotus posture comfort seat which attempts to provide support for users engaged in cross-legged sitting, however, having tried the commercial version of this device, the "lotus seat", I conclude that it is functionally deficient owing to its flat, rather than downwardly angled top surface, which precludes proper pelvic and spinal alignment, and the restrictive manner in which it confines the feet and legs. It is also awkward to carry and store, not inexpensive, and bears a distinct resemblance to a commercial toilet seat, a fact which, in itself, would severely limit its acceptance.

Another and, to my best knowledge, non-patented approach to the cross-legged sitting support problem is the "zazen bench" by Lester, which is essentially an "H" shaped wooden block supporting the buttocks several inches off the ground. This "zazen bench" provides no cushion for feet, ankles and shins, nor even for the buttocks, the ischial tuberosities of which are in direct and painful contact with the wooden surface, as I can testify from personal use.

While certain multi-cushion flexibly hinged mattress devices, such as my own above-mentioned Adjustable Personal Support Apparatus, may be configured in a manner somewhat approximating my new invention, these devices consist of more cushion and hinge elements, and other complexities, than are necessary to meet the specific requirements for cross-legged sitting on any surface. These requirements are, however, uniquely met in my new invention, which is also a handsome article of compact portable furniture that can be easily stored when not in use.

SUMMARY OF THE INVENTION

Two cushions of particular shape and relation are flexibly joined in such manner as to provide optimum support for cross-legged sitting, and may also be folded upon each other for ease of storage and convenient carrying by means of an integral semi-concealed handle.

One of these two cushions has the cross-section of a trapezoid with a horizontal base, two vertical sides of unequal lengths, and a top surface which slants downwards from the longer to the shorter vertical side. This cushion supports the buttocks of the user.

The other cushion has the cross-section of a rectangle whose longer parallel sides are the same length as the cross-sectional base of the trapezoidal cushion, and whose shorter parallel sides are less than the length of the shorter vertical cross-sectional side of the trapezoidal cushion. This cushion supports the shins, ankles and feet of the user.

The cushions are joined by a flexible hinge along a bottom edge of the rectangular cross-sectional cushion, and the bottom edge of the shortest side of the trapezoidal cross-sectional cushion. A handle is attached to the shorter vertical side of the trapezoidal cushion such that it is partially concealed in the slot formed by the flexible hinge between the two cushions when both cushions are extended for sitting. The flexible hinge also permits the retangular cross-sectional cushion to be folded neatly under the trapezoidal cross-sectional cushion for easy transport and storage of the device.

Figure 1:
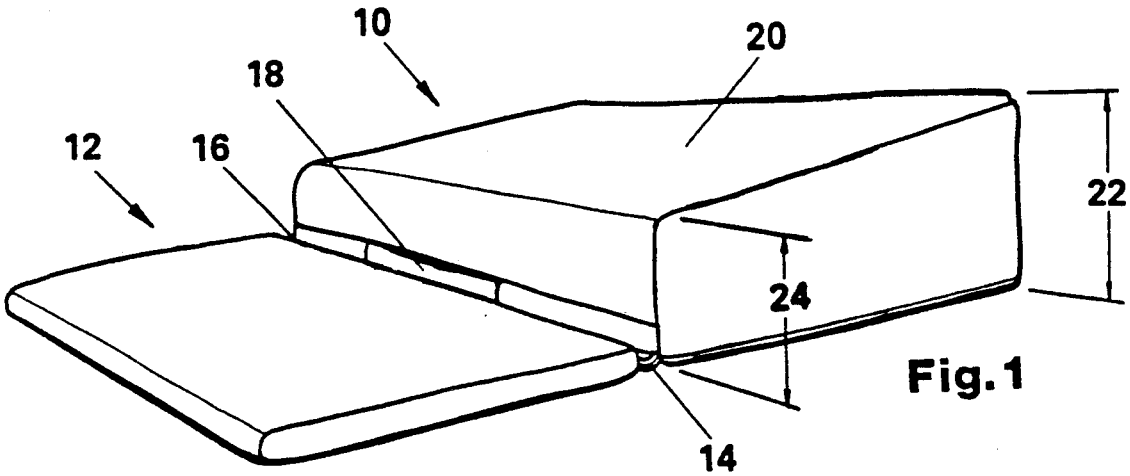
FIG. 1 is a side perspective view of the Cross-Legged Seating Apparatus as it would be configured for sitting.

DESCRIPTION OF THE PREFERRED EMBODIMENT:

FIG. 1 shows the Cross-Legged Seating Apparatus in an open configuration as it would be used for sitting. Trapezoidal cross-sectional cushion 10 is flexibly connected to rectangular cross-sectional cushion 12 via flexible hinge 14, creating a narrow longitudinal slot 16 wherein a compressible handle 18 may be stored. In a preferred embodiment upper surface 20 of cushion 10 slants downward from a maximum height 22 at its end furthest from flexible hinge 14 to a minimum height 24 at its end connecting with the flexible hinge, and forms an angle of approximately 7 degrees with the horizontal.

It will be noted that the width and length of cushion 12 is approximately the same as that of the width and length of the base of cushion 10, which, in a preferred embodiment for an adult, is approximately 15×20 inches, and for a child approximately 12¼ by 15½ inches. In a preferred embodiment the height of cushion 12, in both adult and child versions, is about one inch; the height of the shorter vertical side of cushion 10 is about 4 inches in the adult version, or 3¼ inches in the child version, and the height of the longer vertical side of that cushion is about 6 inches in the adult version, or 4¾ inches in the child version. These aforementioned angles and dimensions provide a majority of cross-legged seated users with ideal pelvic and spinal alignment, however, other angles and dimensions may be desirable in certain situations and are within the scope of my invention.

Figure 2:
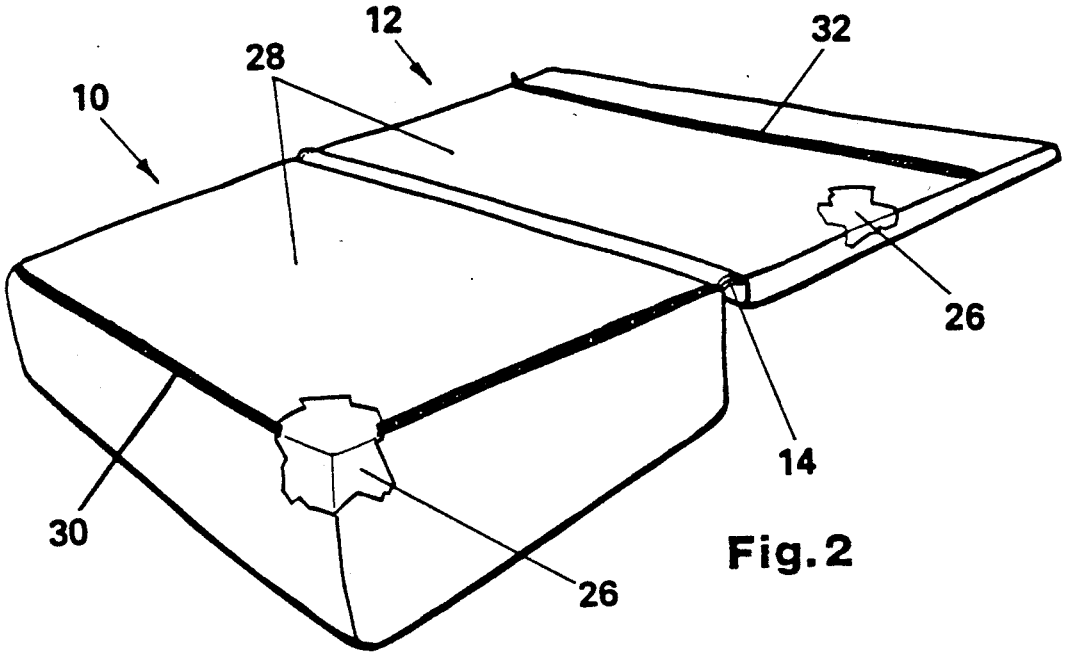
FIG. 2 is a side perspective view of the underside of the Cross-Legged Seating Apparatus.

FIG. 2 shows the underside of the Cross-Legged Seating Apparatus, which would normally be in contact with the floor. In a preferred embodiment both cushions 10 and 12 are filled with 70-IFD urethane foam 26, and are covered with durable fabric 28. In a preferred embodiment zipper 30 for cushion 10 extends continuously in a U-shaped manner around all but the flexibly hinged side of the cushion underside, for ease in inserting or removing the relatively thick foam slab providing support for that cushion. Zipper 32 in cushion 12 forms a line parallel with and about four-fifths the distance between flexible hinge 14 and the rear of that cushion, a U-shaped zipper not here required because the foam support slab for cushion 12 is comparatively thin and hence convenient to insert or remove through a simple slotted opening. In a preferred embodiment flexible hinge 14 is a reinforced doubled-over fabric continuation of durable fabric cover 28.

Figure 3:
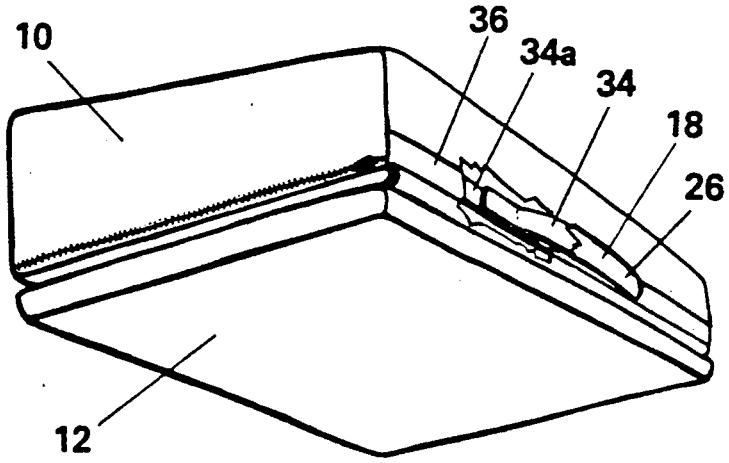
FIG. 3 is a side perspective view of the Cross-Legged Seating Apparatus with its two cushions folded one upon the other as they would be configured for carrying.

FIG. 3 shows the Cross-Legged Seating Apparatus folded over for transport and/or storage after use, with handle 18 clearly visible. In a preferred embodiment this handle is constructed of nylon webbing 34 covered with durable fabric 26 like that used in the cushion covers, and securely mounted to a strip 36 constructed of similar webbing 34*a* covered with similar fabric 26 which runs the length of the bottom of the shorter trapezoidal cross-sectional side of cushion 10. In a preferred embodiment this strip is approximately the same height as the thickness of cushion 12, or 1 inch, thereby permitting the handle to be partially and neatly concealed in the slot formed by the fabric hinge and the hinge-connected vertical sides of the cushions, when the cushions are configured for sitting, as in FIG. 1.

Figure 4:
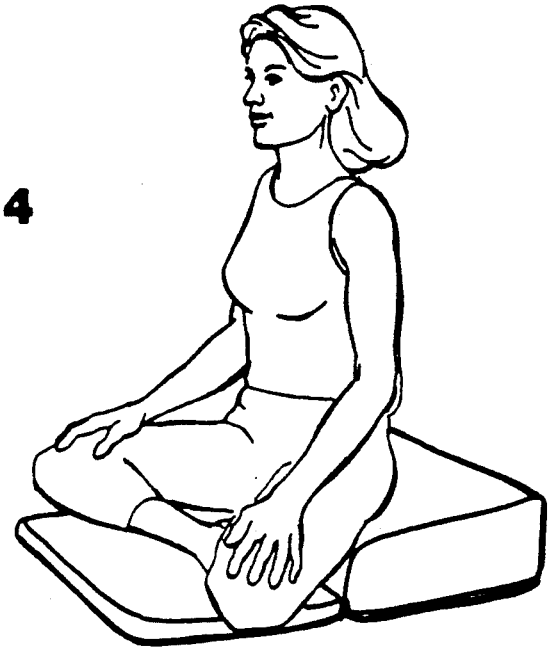
FIG. 4 is a side perspective view of the Cross-Legged Seating Apparatus in use by an adult.

FIG. 4 shows the Cross-Legged Seating Apparatus in an open configuration similar to that shown in FIG. 1, with a user seated in a comfortable and biomechanically advantageous cross-legged position.

Figure 5:
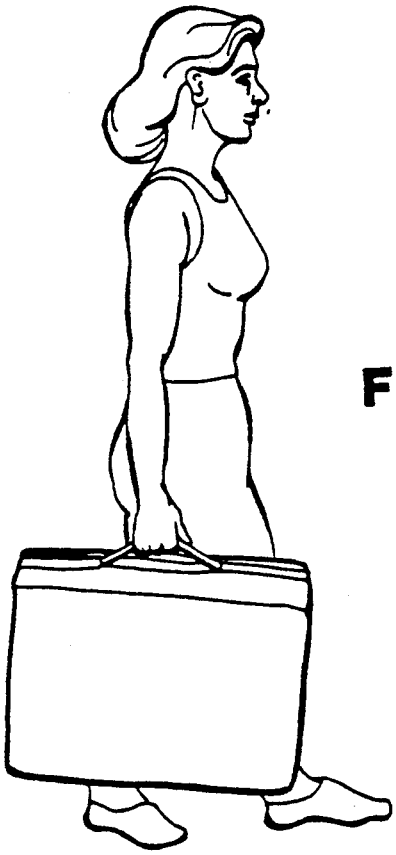
FIG. 5 is a side perspective view of the Cross-Legged Seating Apparatus being carried by its integral handle.

FIG. 5 shows the Cross-Legged Seating Apparatus being carried by handle 18 in a comfortable and convenient manner.

Figure 6:
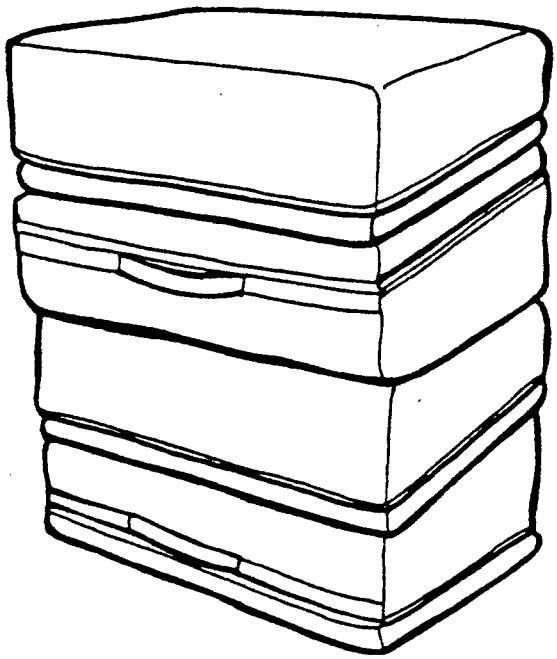
FIG. 6 is a perspective view of a stack of Cross-Legged Seating Apparatuses showing how they may be compactly and attractively stored.

FIG. 6 shows four Cross-Legged Seating Apparatuses compactly stacked one upon the other, with their slanted surfaces alternately arranged in a secure and handsome manner.

Although the description above contains many specificities, these should not be construed as limiting the scope of my invention but as merely providing illustrations of some of its present preferred embodiments and uses. Other embodiments and uses are contemplated, for example, in its above described or somewhat modified form my invention may also be used to provide body support in postural attitudes other than cross-legged sitting, such as kneeling, side-sitting, straight-leg extended sitting, and prone and supine lying, and may, in one or more of these applications, be used synergistically in conjunction with my other furniture inventions, such as my patented Flexibly Hinged Convertible Mattress.

Thus the scope of the invention should be determined by the appended claims and their legal equivalents, rather than by the examples given.

I claim:

1. a cross-legged seating apparatus consisting of:

a cushion of trapezoidal cross-section, said trapezoidal cross-section comprising a horizontal base; two vertical sides of unequal length; and an angled top side connecting the unequal vertical sides; and a cushion of rectangular cross-section, said rectangular cross-section having two opposite vertical sides each of a length not greater than the length of the shorter vertical side of said trapezoidal cross-section, and further having two opposite horizontal sides each of a length substantially the same as the length of said base of said trapezoidal cross-section; and means for flexibly attaching said trapezoidal cross-sectional cushion to said rectangular cross-sectional cushion along the common edge of said base and said shorter vertical side of said trapezoidal cross-sectional cushion, and the common edge of one said vertical side and the lowermost horizontal side of said rectangular cross-sectional cushion, whereby said cross-legged seating apparatus may be used for comfortable and biomechically correct floor-based seating on any floor surface, and said rectangular cross-sectional cushion may be folded back upon the underside of said trapezoidal cross-sectional cushion to permit ready transport and storage of said cross-legged support apparatus.

2. The article of claim 1 wherein the means for flexibly attaching said trapezoidal cross-sectional cushion to said rectangular cross-sectional cushion is a reinforced fabric hinge.

3. The article of claim 1 wherein the cushions are made of fabric covered flexible foam.

4. The article of claim 3 wherein said flexible foam has an IFD of approximately 70.

5. The article of claim 1 wherein the angle formed by a horizontal plane and the downwardly-slanting top surface of said trapezoidal cross-sectional cushion is between about 5 and 15 degrees, whereby desirable spinal alignment may be obtained when using said article for cross-legged sitting.

6. The article of claim 1 further including a compressible handle means attached to said shorter vertical side of said trapezoidal cross-sectional cushion, at a point midway along the bottom edge of said shorter vertical side, said handle means having a height not substantially greater than said length of one said vertical side of said rectangular cross-sectional cushion, whereby said handle means may be tucked into a slot formed by said flexible attachment means and said shorter vertical side of said trapezoidal cross-sectional cushion and one said vertical side of said rectangular cross-sectional cushion, when said article is used for sitting.

7. The article of claim 6 wherein the compressible handle means is fabric covered nylon webbing.

* * * * *